US005782728A

United States Patent [19]

Morrison

[11] Patent Number: 5,782,728

[45] Date of Patent: Jul. 21, 1998

[54] FITNESS DEVICE

[75] Inventor: Milford D. Morrison, 3999 E. Dartmouth Ave., Denver, Colo. 80210

[73] Assignee: Milford D. Morrison, Denver, Colo.

[21] Appl. No.: 493,887

[22] Filed: Jun. 23, 1995

[51] Int. Cl.[6] ..... A63B 22/00; A63H 33/26

[52] U.S. Cl. ..... 482/148; 446/450

[58] Field of Search ..... 482/51, 148, 74, 482/132; 33/780, 781; 446/450, 267, 438, 485; 273/128 R, 128 A

[56] References Cited

U.S. PATENT DOCUMENTS

| | | | |
|---|---|---|---|
| 3,123,937 | 3/1964 | Pace | 446/450 |
| 3,881,277 | 5/1975 | Delph et al. | 446/450 |
| 4,257,189 | 3/1981 | Hensley | 446/450 |
| 4,308,662 | 1/1982 | Losch | 33/781 |
| 4,495,813 | 1/1985 | Lojko et al. | 33/782 |
| 4,911,675 | 3/1990 | Rogers | 446/450 |

*Primary Examiner*—Stephen R. Crow
*Attorney, Agent, or Firm*—Holme Robert & Owen

[57] ABSTRACT

A fitness device for controlling the speed and/or direction of a rolling round member. In one embodiment, the present invention includes a round member and a separate hand-held assembly. The hand-held assembly may comprise an upstanding member positioned between a handle assembly and an engaging member. When the fitness device is moved vertically, laterally, in a twisting fashion, or a combination thereof, such that the engaging member contacts the round member during such motion, the speed and/or direction of the round member may be altered.

29 Claims, 4 Drawing Sheets

FITNESS DEVICE

FIELD OF THE INVENTION

The present invention generally relates to the field of fitness devices and, more particularly, to a physical fitness apparatus that includes a round member and a separate hand held member for initiating and controlling the movement and direction of the round member.

BACKGROUND OF THE INVENTION

Over the years, there has been an increased awareness and concern with physical fitness, and more specifically, with exercising to reduce body fat and risks associated with heart disease and other ailments and to improve physical strength, stamina and coordination. In response to these concerns, aerobic activities such as jogging, roller-skating, swimming and biking gained popularity among those wishing to improve their physical well-being. In spite of the fitness value of these conditioning activities, many consider these activities tedious and monotonous due to the repetitiveness of motions and/or limitations upon muscle groups being exercised. For example, many adults become disenchanted with jogging as it is repetitive and exercises primarily the lower body muscles (e.g., thigh and calf muscles) and not the upper body muscles (e.g., arm, shoulder, chest and back muscles). In addition, kids desiring a fun, individualized outdoor activity become disinterested in running and jogging as these activities do not test, challenge and/or develop their balance, hand-eye coordination and/or physical dexterity.

Other fitness activities, such as in-line skating and mountain biking have been developed and promoted to attract and hold the interest of participants. However, these activities, being variations of the aforementioned "tedious" activities, also exhibit limitations as they primarily exercise the lower body muscles. In addition, while kids enjoy the challenges associated with individualized activities like in-line skating and mountain biking, the costs associated with purchasing in-line skates and mountain bikes can amount to hundreds of dollars. As such, participating in in-line skating and mountain biking can be prohibitively expensive, especially for kids.

Activities such as tennis and racquetball are beneficial as they improve aerobic conditioning, exercise both the upper and lower body muscles and improve hand-eye coordination. Although tennis and racquetball are not considered as "tedious" as the aforementioned activities, such activities can also be prohibitively expensive due to costs associated with equipment, namely, racquets and shoes, and fees for court time and/or lessons. Furthermore, such activities are not individualized as they typically require a partner to participate. As such, kids cannot participate in and enjoy such activities any time they choose.

Various high-technology equipment has been developed to exercise both the upper and lower body muscles. A cornucopia of fitness machines, such as the treadmill, stair-climbers, stationary bikes and various weight machines, may be used to improve aerobic conditioning and exercise both the lower and upper body muscles. Unfortunately, such high-technology fitness equipment is very expensive. As such, such machines are typically available for use only at health or fitness clubs by its members. However, membership to such clubs can total hundreds of dollars per year.

SUMMARY OF THE INVENTION

Accordingly, it is an object of the present invention to provide a physical fitness apparatus which is enjoyable and yet challenging for both kids and adults.

Another specific object of the invention is to provide a physical fitness apparatus that exercises the upper and lower body muscles, improves aerobic conditioning and hand-eye coordination.

Another specific object of the invention is to provide a physical fitness apparatus that may be enjoyed individually or with other persons.

Another specific object of the invention is to provide a physical fitness apparatus which is inexpensive, easy to use, and easy to assemble.

Another specific object of the invention is to provide a physical fitness apparatus which can be used by almost anyone, regardless of height, weight and/or level of fitness.

Accordingly, this application is directed to a physical fitness apparatus that includes a round member and a separate elongated hand-held member having an engaging member at one end for rolling and controlling the round member. In order to initiate rolling of the round member and to control the movement and direction of the round member, the engaging member has a mouth portion capable of contacting portions of the round member. In a preferred embodiment, the mouth portion is sized such that a width of the engaging member may be positioned around at least a portion of the round member thereby enhancing the ability to control the movement and direction of the round member during use. Moreover, the mouth portion is sized to include a depth such that at least a portion of the round member may be received within the mouth to further enhance the ability to control the movement and direction of the round member during use. In this regard, the mouth portion of the engaging member may be configured such that a middle leg extends between two legs in a prong or forklike fashion. Corner portions adjoining the middle leg with the two legs may be arcuate in order to further enhance controllability over the round member while the middle leg may include an arcuate or flat portion to intermittently engage the round member thereby keeping the round member rolling.

In order manipulate the engaging member to thereby control the movement and direction of the round member, the engaging member is interconnectable with a hand-held member via an upstanding member. The engaging member may be interconnected to the upstanding member at an obtuse angle relative thereto, between about 110° and about 160°. More preferably, the engaging member is connectable to the upstanding member at an angle relative thereto between about 120° and about 150°. The upstanding member connects to the hand-held member at an obtuse angle relative thereto between about 110° and about 160°. More preferably, the hand-held member is connectable to the engaging member at an angle relative thereto between about 120° and about 150°.

The hand-held member allows for adjustability in the length of the physical fitness apparatus and, more specifically, the distance between the hand-held member and the engaging member. Adjustability of the physical fitness apparatus may be provided by an end portion of the hand-held member, which is sized to fit into a bore which longitudinally extends within a portion of the upstanding member from an upper end of the upstanding member. Adjustability may also be provided by having an upstanding member which includes a telescoping member.

DETAILED DESCRIPTION

Figure 1:
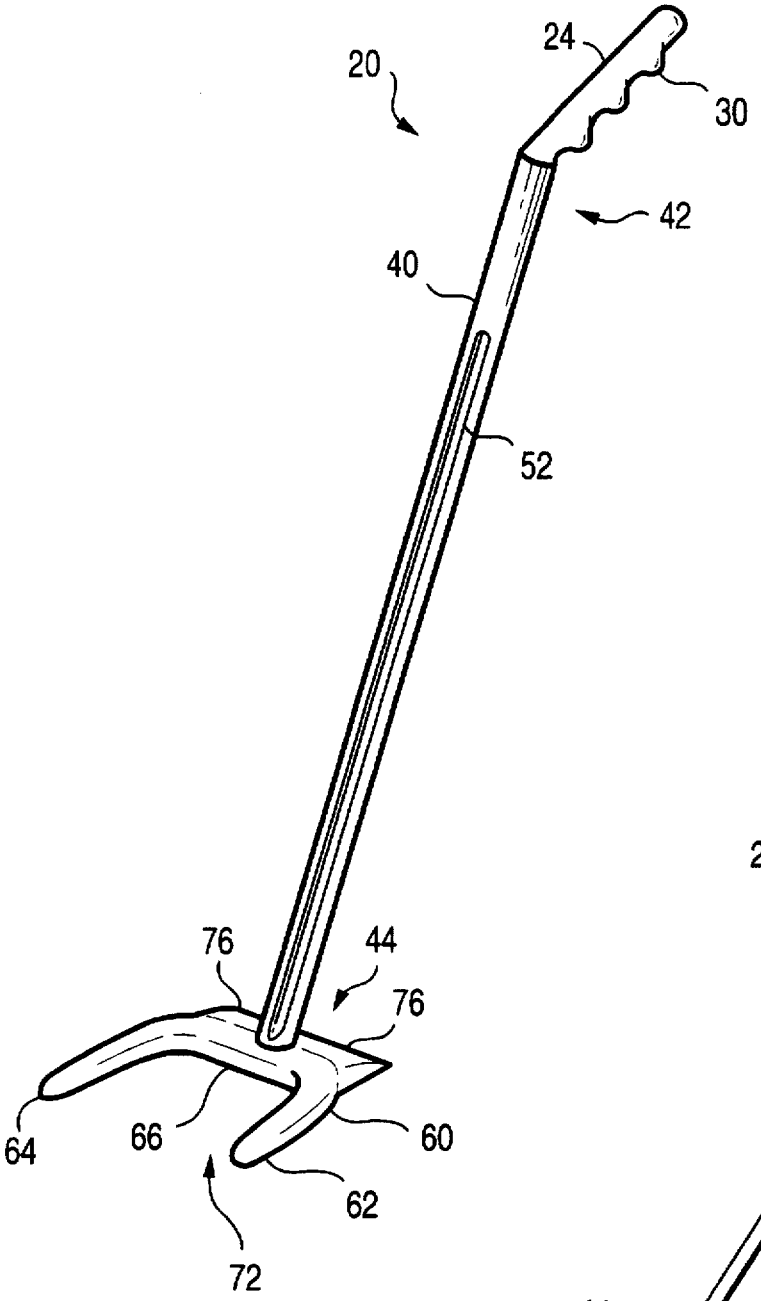
FIG. 1 is a perspective view of an embodiment of the fitness device according to the present invention.

The present invention will be described with reference to the attached drawings which illustrate the pertinent features thereof. The present invention is generally illustrated in FIGS. 1–5. The fitness device 20 generally includes a handheld assembly and a round member. The hand-held assembly may include a handle assembly 24, an upstanding member 40 having first and second ends 42, 44 and an engaging member 60. The handle assembly 24 may be appropriately attached to the first end 42 (i.e., the upper portion) of the upstanding member 40 and the engaging member 60 may be appropriately connected to the second end 44 (i.e., the lower portion) of the upstanding member 40. In this regard, a user of the fitness device 20 may grasp or hold the fitness device 20 about the handle assembly 24 such that the fitness device 20 is held in front of or to either side of the user. As such, a user may manipulate and control the speed and/or direction of a round member 80 rolling upon a support surface by moving his or her arm (and correspondingly the fitness device 20) generally vertically, laterally, in a twisting fashion, and/or combinations thereof, when contacting portions of the round member 80 with the engaging member 60 of the fitness device 20.

Figure 2:
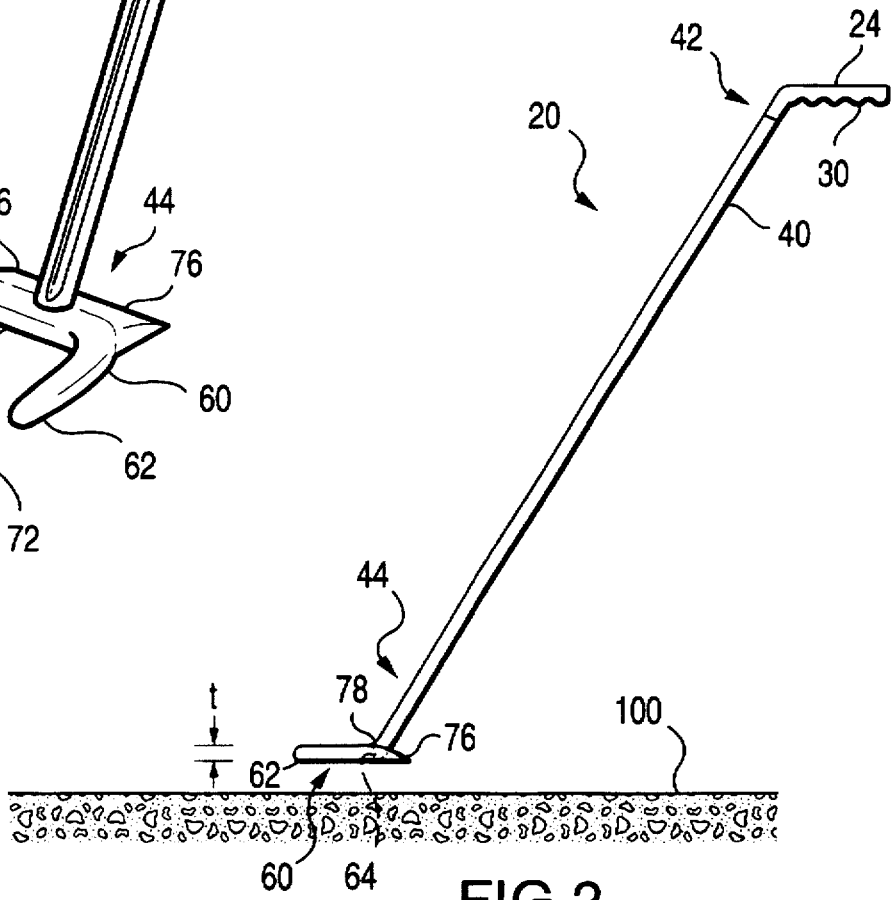
FIG. 2 is a side view of an embodiment of the fitness device according to the present invention.
Figure 3:
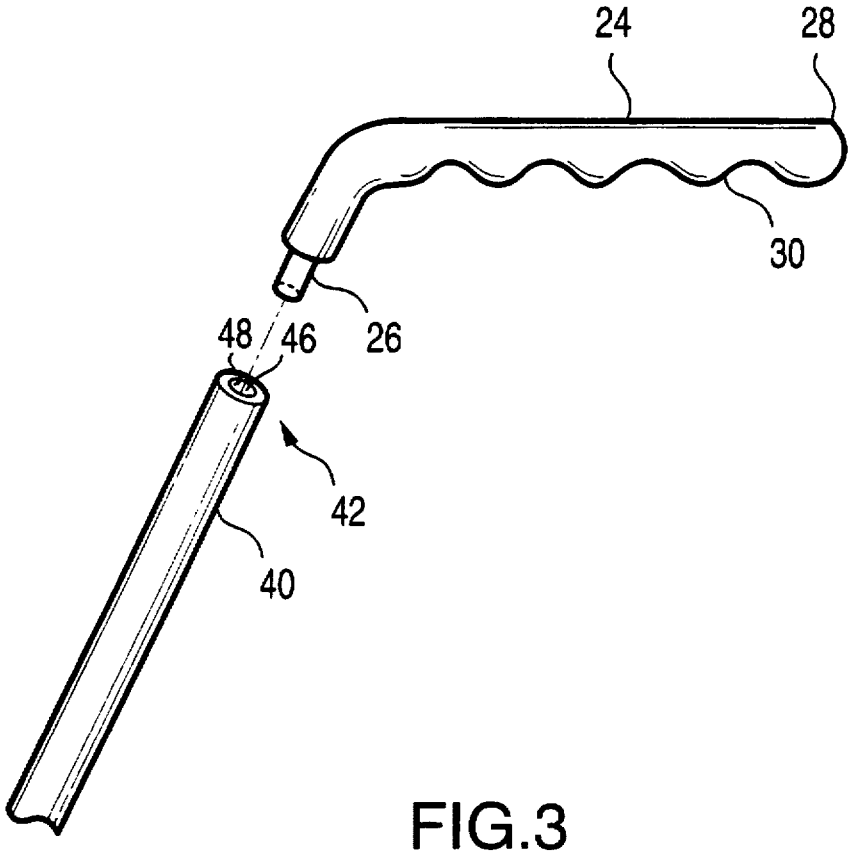
FIG. 3 is a perspective view of one embodiment of the handle assembly and the upper portion of the upstanding member.
Figure 4:
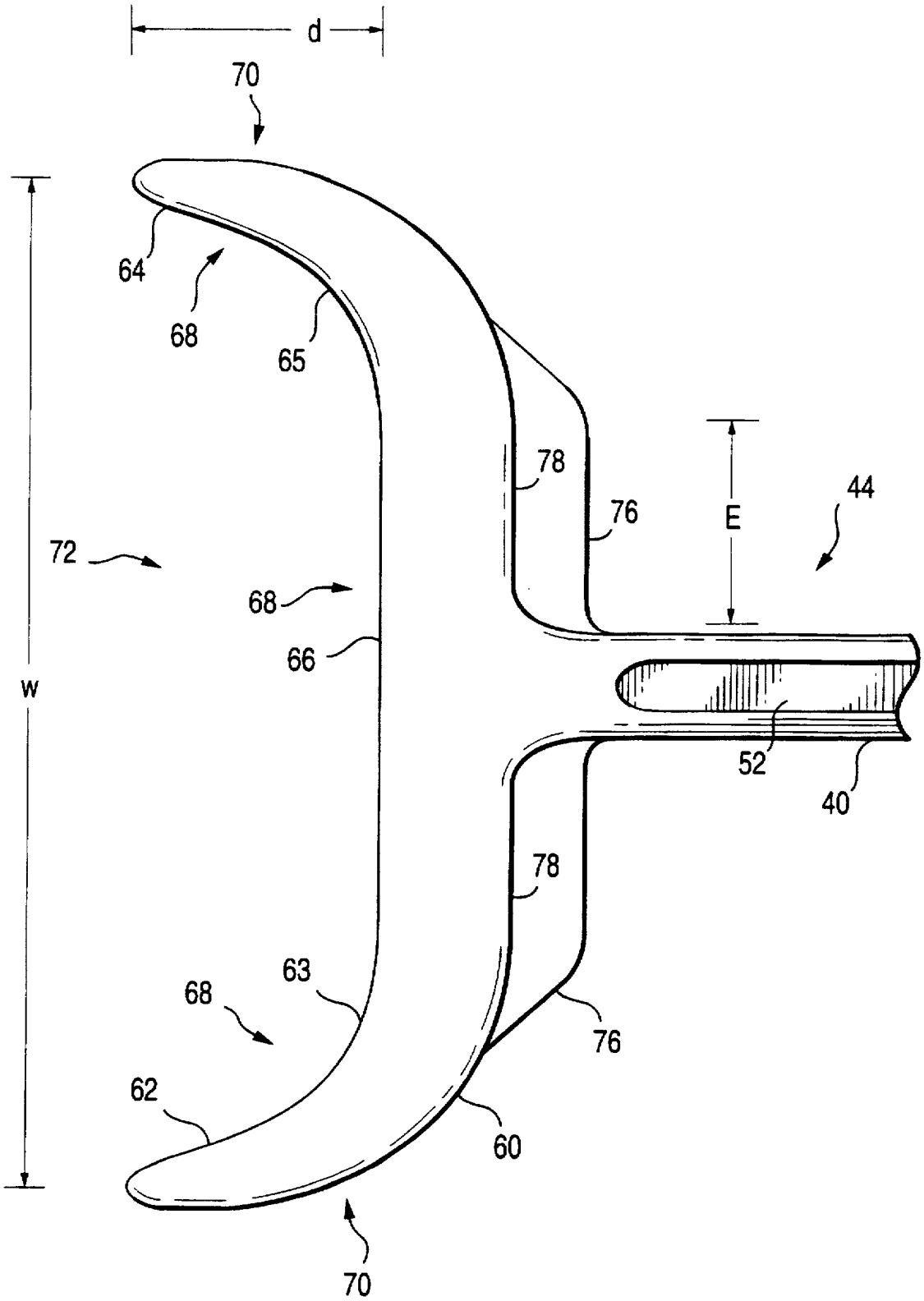
FIG. 4 is a top view of one embodiment of the lower portion of the upstanding member and the engaging member according to the present invention.

The fitness device 20 and the individual components thereof are illustrated in detail in FIGS. 1–5. As illustrated in FIGS. 1–2 and 4, the hand-held assembly of the fitness device 20 may comprise an engaging member 60. In order to enhance the ability to control the direction and/or rolling movement of the round member 80, the engaging member 60 may have a mouth portion 72 which is sized to engage at least a portion of the round member 80. In this regard, the width ("w") of the mouth portion 72 should be sized greater than the width of the round member 80 and the depth ("d") of the mouth portion 72 should be sized such that at least a portion of the round member 80 may be received within the mouth portion 72.

The engaging member 60 may comprise first and second legs or prongs 62, 64, respectively, and a middle leg 66 therebetween. In order to effectively control the direction of the round member 80 (e.g., steer the round member 80, as will be described below), the corner portions 63, 65 of the engaging member 60 may be arcuate. Furthermore, the interior surface 68 of the middle leg 66 may be arcuate or flat so as to enhance initiating and continuing the rolling motion of the round member 80. In order to effectively control the speed and direction of the round member 80, the interior and/or exterior surfaces 68, 70 of the first, second and/or middle legs 62, 64, 66 of the engaging member 60 are substantially rounded. In a preferred embodiment, the ratio between the distance between the first and second legs 62, 64 to the width or diameter of the round member 80 should be between about 2:1 and about 15:1.

The engaging member 60 primarily functions to control the speed and direction of the round member 80 by contacting a portion of the round member 80 with the first, second or middle legs 62, 64, 66 as the fitness device is moved vertically, laterally, twistedly or a combination thereof. For example, an interior surface 68 or an exterior surface 70 of the engaging member 60 may contact a side of the round member 80 in order to steer the round member 80 in a desired direction. The corner portion 63 or the interior surface 68 of the first leg 62 (or the exterior surface 70 of the second leg 64) of the engaging member 60 may contact the left side of the round member 80 in order to direct the round member 80 to the right. Conversely, the operator may manipulate the fitness device 20 such that the corner portion 65 or the interior surface 68 of the second leg 64 (or the exterior surface 70 of the first leg 62) of the engaging member 60 contacts the right side of the round member 80 to direct the round member 80 to the left. Similarly, in order to increase the speed of the round member 80, the operator may manipulate the fitness device 20 such that the first, second or middle leg 62, 64, 66 of the engaging member 60 contacts a lower portion of the round member 80 with a "lifting" type of motion. The engaging member 60 may also be used to stop the forward rolling motion of the round member 80 by frictionally engaging an upper portion (e.g., the top) of the round member 80.

Since the engaging member 60 is disposed at the second end 44 of the upstanding member 40 (and can thereby generate substantial rotational forces) and intermittently contacts the round member 80, the engaging member 60 should be composed of or coated with a light-weight and durable material. In a preferred embodiment, the engaging member 60 is composed of a moldable material, such as polymer-based material, and more specifically, polyurethane, polystyrene, polyolefin, polytetraflouroethylene or polyethylene, or, alternatively, may be composed of wood or a light-weight metal, such as aluminum or aluminum alloys.

The handle assembly 24, illustrated in FIGS. 1–3, primarily functions to provide a means by which the fitness device 20 may be grasped and manipulated by the user at a height substantially corresponding to an area of the user between the user's knees and chest or torso region. Thus, the fitness device 20 may be comfortably held and manipulated as the user is jogging, running and/or walking. In this regard, upper portion 26 and/or the grip 30 of the handle assembly 24 is substantially disposed at an obtuse angle relative to the lower portion 28 such that the upstanding member 40 extends downwardly and frontwardly relative to the user. In a preferred embodiment, the handle assembly 24 is disposed at an angle between about 110° and about 160° relative to the upstanding member 40, and more preferably between about 120° and about 150°. This allows for the engaging member 60 to contact the round member 80, which typically rolls along a support surface in front of the user. Thus, in a preferred embodiment, the handle assembly 24 assumes a curved or bent configuration as illustrated in FIG. 3.

As noted above, the handle assembly 24 may be connected to the first end 42 (i.e., upper portion) of the upstanding member 40. In this regard, the handle assembly 24 may be mechanically fastened (e.g., screwed, clamped or taped) or chemically bonded (e.g., glued, fused, melded or welded) to or integrally formed with first end 42 of the upstanding member 40. In a preferred embodiment, illustrated in FIG. 3, an end portion 26 of the handle assembly 24 may be secured to the first end 42 of the upstanding member 40 by inserting the end portion 26 of the handle assembly 24 into a bore 46 (as will be described below) in a male-female type fashion such that the end portion 26 frictionally engages the inner wall 48 of the upstanding bar 40. In this regard, the end portion 26 provides adjustability in length of the fitness apparatus 20 as the end portion 26 is sized such that it may be inserted into the bore 46 at any point along the length of the upstanding bar 40. More specifically, adjustability in length of the upstanding member 40 may be achieved by cutting or sawing off a selected length from the upper portion of the upstanding member 40. In order to provide a means for interconnecting the handle assembly 24 with upper portion of the upstanding member 40, the bore 46 may extend from the first end 42 of the upstanding member towards the second end 44. In fact, the bore 46 may extend between the first and second ends 42, 44 such that the length of the upstanding member 40 is adjustable to any length desired. In such instances, to provide for a secure connection between the handle assembly 24 and the upstanding member 40, the diameter of the bore 46 should be the same throughout the length of the upstanding member 40 such that the end portion 26 of the handle assembly 24 may frictionally engage the inner wall 48 of the upstanding member 40. Adjustability in length of the fitness device 20 may also be provided by a telescoping member associated with the handle assembly 24 (not shown) and/or the upstanding member 40, shown in FIG. 5 (which will be described hereinbelow).

The handle assembly 24 may also include a grip 30 extending between the lower (i.e., end) and upper portions 26, 28 of the handle assembly 24. The grip 30 functions to provide the user of the fitness device 20 a comfortable and reliable (i.e., slip-free) interface between the fitness device 20 and a user's hand, which can be damp with perspiration during strenuous physical activity, such as running. In this regard, the grip 30 allows the user to reliably and accurately manipulate and thereby position the engaging member 60 for contact with the round member 80. In a preferred embodiment, illustrated in FIGS. 2–3, a portion of the grip 30 assumes a sinusoidal configuration such that the handle assembly 24 may be comfortably and securely grasped by a user's hand. The grip 30 may be integrally formed with the handle assembly 24 or, alternatively, interface with the handle assembly 24 in a sleeve-like fashion (i.e., male-female).

In order to provide a lightweight, durable and easily controllable fitness device 20, the handle assembly 24 may be fabricated from a light-weight material, such as plastic, metal (e.g., aluminum) or wood. In a preferred embodiment, the handle assembly 24 is composed of a moldable material, such as polymer-based material, and more specifically, polyurethane, polystyrene, polyolefin, polytetraflouroethylene or polyethylene. The grip 30 may also be fabricated from a molded material, such as the above-noted polymer-based materials, or, alternatively, may be fabricated from a wood, rubber or foam-based material. In addition, the handle assembly 24, including the grip 30 and the end portion 26, may be a unitary (i.e., one-piece) body fabricated from the aforementioned molded materials.

Figure 5:
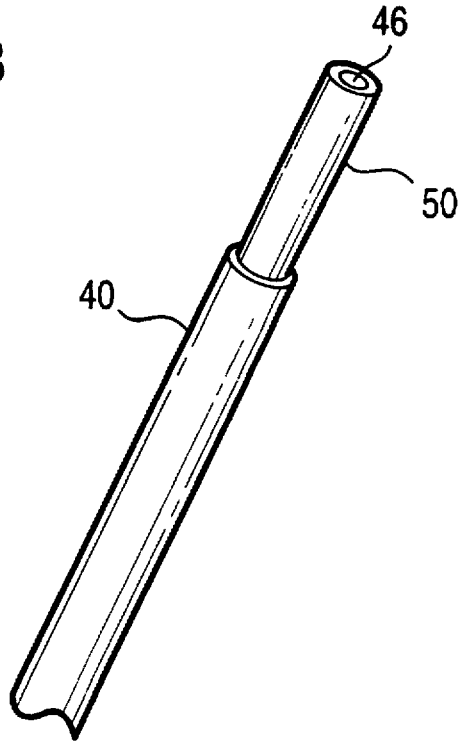
FIG. 5 is a perspective view of one embodiment of an upstanding member having a telescoping member.

The upstanding member or bar 40, illustrated in FIGS. 1–4, is generally elongated and extends longitudinally between first and second ends 42, 44, which substantially correspond to upper and lower portions of the upstanding member 40. The upstanding member 40 primarily functions to interconnect the handle assembly 24 with the engaging member 60. In this regard, the upstanding member 24 should be of a length by which a user can easily and comfortably control the rounded member 80, which rolls along at ground level. In one embodiment, to accommodate users of varying heights and arm lengths, the length of the upstanding member 40, and therefore the fitness device 20, is adjustable. In order to provide such adjustability, the upstanding member 40, or alternatively, the handle assembly 24, may be provided with at least one telescoping member 50, as shown in FIG. 5. Where such a telescoping member 50 is used, annular bushings (not shown) may be provided on the outer wall of the telescoping member 50 to interface (i.e., frictionally engage) with an inner wall of the upstanding member 40.

Figure 6A:
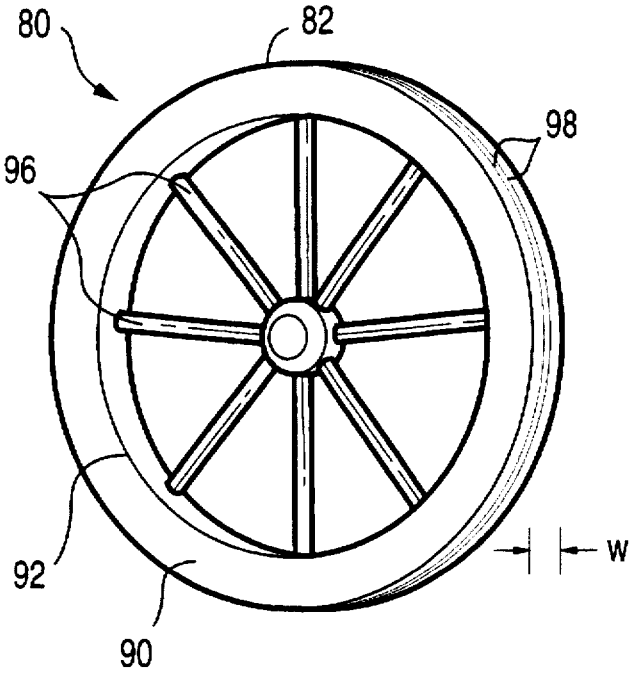
FIG. 6*a* is a perspective view of one embodiment of a round member according to the present invention.
Figure 6B:
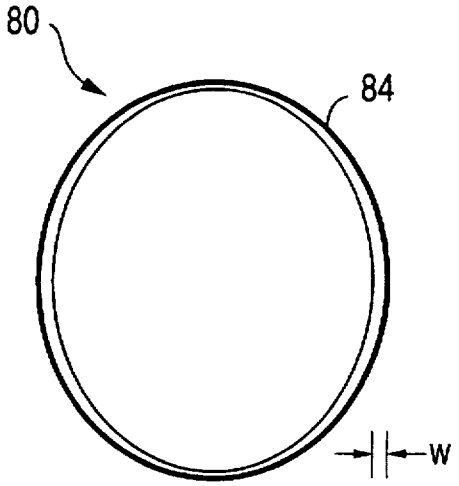
FIG. 6*b* is a perspective view of another embodiment of a round member according to the present invention.
Figure 6C:
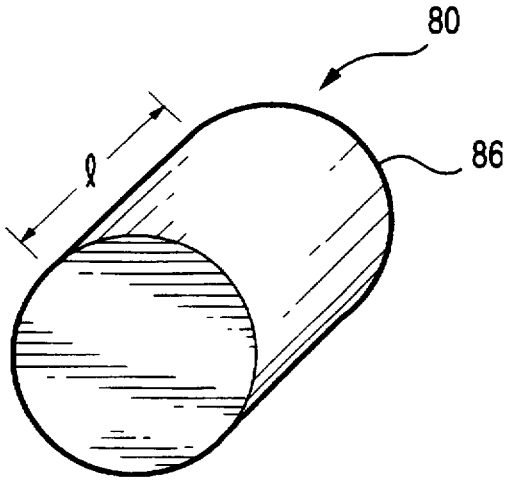
FIG. 6*c* is a perspective view of another embodiment of a round member according to the present invention.
Figure 6D:
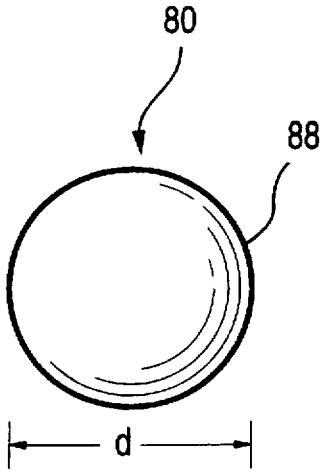
FIG. 6*d* is a perspective view of another embodiment of a round member according to the present invention.

The upstanding member 40 may also comprise a groove 52 which extends along a length of the upstanding member 40, substantially between the first and second ends 42, 44. The groove 52 functions to provide a means by which the round member 80 may commence rolling. In this regard, the upstanding member 40 may function as a ramp as a round member 80 may be placed atop the upstanding member 40 within the groove 52 and released to start a forward rolling motion of the round member 80. The depth and width or radius of the groove 52 may be selected so as to provide a path or track upon which the round member 80 will follow such that the round member 80 will roll forward from the fitness device 20 and the operator when released. In this regard, width and depth of the groove 52 should be selected so as to accommodate a dimension or portion of the round member 80. For example, where the round member 80 comprises a wheel 82 or a ring 84, as shown in FIGS. 6*a*–6*b*, respectively, the width of the groove should be greater than the width of the wheel 82 or ring 84. In a preferred embodiment, the groove 52 is integrally formed in the outer wall of the upstanding member 40. Alternatively, a separate groove member (not shown) may be mounted on the upstanding member 40 by any suitable fastening means (e.g., screws, clamps, glue, welding, etc.).

The fitness device 20 may also comprise at least one ramp 76. The primary function of the ramp 76 is to provide a means by which the round member 80 may be made to jump or hop over an obstruction in the path of the rolling round member 80 (e.g., sidewalk curbs, prone persons, insects or small animals, puddles of water, etc.). To facilitate such jumps of the round member 80, the upper portion 78 of the ramp 76 should rise to a height generally corresponding to the thickness of the engaging member 60, as illustrated in FIG. 2. In addition, the ramp 76 should have a width corresponding to a dimension of the round member 80. For example, where the round member 80 comprises a wheel 82, the ramp 76 should have a width greater than the width of the wheel 82. Similarly, where the round member 80 comprises a ball 88, the ramp 76 should have a width greater than the diameter of the ball 88.

The ramp 76 may be associated with the engaging member 60 and/or the second end 44 (lower portion) of the upstanding member 40. In this regard, the ramp 76 may be integrally formed with or mechanically fastened (e.g., screwed, clamped, taped etc.) to or chemically bonded with (e.g., glued, melded, fused or welded) the upstanding member 40 and/or the engaging member 60. The ramp 76 may comprise a moldable material, such as polymer-based material, and more specifically, polyurethane, polystyrene, polyolefin, polytetraflouroethylene or polyethylene, or, alternatively, may be composed of wood or a light-weight metal, such as aluminum or aluminum alloys.

Since the primary function of the round member 80 is to roll on a support surface (e.g., ground or paved surface), the round member 80 may assume a variety of round shapes. As illustrated in FIGS. *6a–6d*, the round member 80 may comprise a wheel 82, a ring 84, a cylinder 86 (e.g., a can) or a ball 88. In a preferred embodiment, the round member 80 comprises a wheel 82 having a tire 90 mounted on a wooden or metal rim 92 and a plurality of metal spokes 96 for structural stability. The tire 90 may include a plurality of grooves 98 about the circumference of the tire 90. Such grooves 98 improve the maneuverability and traction of the wheel 82. In addition, for purposes of providing a durable and controllable wheel 82, the tire 90 may be composed of a hard rubber. Round members 80 assuming a ring, cylinder or spherical configuration may be fabricated from metal, wood, rubber or plastic.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known of practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A fitness device comprising:

a round member rollable on a support surface; and a separate hand-held assembly comprising:

a handle member;

an upstanding member having longitudinally displaced upper and lower portions, said upper portion being connected to said handle member;

an engaging member having a forwardly extending mouth portion sized to receive at least a portion of said round member therein for controlling said round member, said engaging member connected to said lower portion of said upstanding member; and a first rearwardly extending ramp, positioned on said engaging member, adapted to propel said round member up and over at least said engaging member, wherein at least a portion of said round member is rollable on said first rearwardly facing ramp, said first rearwardly facing ramp having a sloped surface extending rearwardly and downwardly, relative to and from a top portion of said mouth portion of said engaging member.

2. A fitness device as claimed in claim 1, wherein said handle member is disposed at an obtuse angle relative to said upstanding member.

3. A fitness device as claimed in claim 1, wherein said upstanding member further comprises a longitudinally extending groove for initiating movement of said round member, said groove extending between said upper and lower portions of said upstanding member.

4. A fitness device as claimed in claim 1, wherein said mouth portion of said engaging member comprises a middle leg extending between first and second laterally displaced legs.

5. A fitness device as claimed in claim 4, wherein said mouth portion further comprises first and second corner portions interconnecting said first and second legs to said middle leg, respectively.

6. A fitness device as claimed in claim 5, wherein said corner portions are arcuate.

7. A fitness device as claimed in claim 4, wherein said middle leg of said engaging member is flat.

8. A fitness device as claimed in claim 4, wherein said middle leg of said engaging member is arcuate.

9. A fitness device as claimed in claim 4, wherein said first and second legs are rounded.

10. A fitness device as claimed in claim 1, wherein a ratio between the distance between said first and second legs of said engaging member to a width of said round member is between about 2:1 to about 15:1.

11. A fitness device as claimed in claim 1, wherein said engaging member is disposed at an obtuse angle relative to said upstanding member.

12. A fitness device as claimed in claim 1, wherein said round member is selected from one of the following: wheels, rings, cylinders and spheres.

13. A fitness device as claimed in claim 1, wherein said round member comprises a wheel having grooves about a circumference of said wheel.

14. A physical fitness apparatus for controlling a round member rollable on a support surface comprising:

a handle assembly;

an upstanding member having first and second ends, said upstanding member being interconnectable with said handle assembly at said first end;

an engaging means, interconnected with said second end of said upstanding member, for intermittently contacting the round member to control and guide the round member, said engaging means having a forwardly facing mouth portion: and a rearwardly facing ramp positioned on said engaging means adapted to propel the round member up and over at least said engaging means, wherein the round member is rollable on said rearwardly facing ramp, said rearwardly facing ramp having a sloped surface extending rearwardly and downwardly, relative to and from a top portion of engaging means.

15. A fitness device, as claimed in claim 14, wherein said handle assembly comprises an end portion connectable to said first end of said upstanding member.

16. A fitness device, as claimed in claim 14, wherein said handle assembly comprises a grip member.

17. A fitness device, as claimed in claim 15, wherein said handle assembly comprises a molded material.

18. A fitness device, as claimed in claim 14, wherein said first and second ends of said upstanding member define a length of said upstanding member, wherein said length of the fitness device is adjustable.

19. A fitness device, as claimed in claim 18, wherein said upstanding member comprises at least one telescoping member.

20. A fitness device, as claimed in claim 18, wherein said upstanding member further comprises a bore extending through at least a portion of said upstanding member from said first end towards said second end, said first end of said upstanding member being frictionally interconnectable with said handle assembly by inserting a portion of said handle assembly into said bore at said first end of said upstanding member.

21. A fitness device, as claimed in claim 14, wherein said upstanding member is displaced at an obtuse angle relative to said handle assembly.

22. A fitness device, as claimed in claim 14, wherein said upstanding member further comprises a longitudinal groove extending between said first and second ends.

23. A fitness device, as claimed in claim 22 wherein a width of said groove is greater than a width of the round member.

24. A fitness device, as claimed in claim 14, wherein said engaging means is interconnected said second end of said upstanding member.

25. A fitness device, as claimed in claim 14, wherein said mouth portion comprises a middle leg extending between laterally displaced first and second legs.

26. A fitness device, as claimed in claim 25, wherein a distance between said first and second legs of said engaging means is greater than a width of the round member.

27. A fitness device, as claimed in claim 14, wherein a surface of said engaging means is substantially arcuate.

28. A fitness device as claimed in claim 14, wherein a width of said ramp is greater than a width of the round member.

29. A fitness device as claimed in claim 14, wherein said engaging means is disposed at an obtuse angle relative to said upstanding member.

* * * * *